United States Patent [19]

Guo

[11] Patent Number: 5,048,991

[45] Date of Patent: Sep. 17, 1991

[54] STRUCTURE OF DRIVING THE BALL REFILL FOR A BALL POINT PEN

[76] Inventor: Ching-Chung Guo, No. 29, La. 14, Ho Ping Rd., Panchiao, Taipei, Taiwan

[21] Appl. No.: 547,148

[22] Filed: Jul. 3, 1990

[51] Int. Cl.[5] ..... B43K 5/16; B43K 24/02; B43K 21/08

[52] U.S. Cl. ..... 401/116; 401/109; 401/110; 401/75

[58] Field of Search ..... 401/116, 71, 99, 68, 401/69, 75, 109, 110, 111, 112, 117

[56] References Cited

U.S. PATENT DOCUMENTS

| | | | |
|---|---|---|---|
| 2,173,600 | 9/1939 | Thompson | 401/116 X |
| 2,753,844 | 7/1956 | Boss | 401/116 |
| 4,786,197 | 11/1988 | Koeln | 401/99 |
| 4,844,640 | 7/1989 | Ganz | 401/116 |

FOREIGN PATENT DOCUMENTS

| | | | |
|---|---|---|---|
| 181624 | 6/1922 | United Kingdom | 401/116 |

*Primary Examiner*—Danton D. DeMille
*Attorney, Agent, or Firm*—Wenderoth, Lind & Ponack

[57] ABSTRACT

A refillable ballpoint pen structure in which the refill can be extended or retracted by relative rotation of the parts of the pen structure through 360°. A driving casing tube is fixed in the upper end of a body tube and an external casing tube is fitted over the driving casing tube for relative rotation but not axial movement. A driving axial tube is rotatable within the driving casing tube and is axially slidable and non-rotatably engaged with the interior of the external casing tube. The driving casing tube has a sinuously curved groove therearound, in which an inwardly projecting projection on the driving casing tube is engaged for causing longitudinal movement of the driving axial tube upon relative rotational movement between the driving axial tube and the driving casing tube. A spring is fitted between the driving axial tube and the driving casing tube and a cap is fitted over the external casing tube and in which the external casing tube is relatively axially slidable and non-rotatable. With a ballpoint pen refill having a ballpoint thereon held fixed in relation to the driving axial tube, relative rotation of the cap and body tube causes relative rotation of the driving axial tube and driving casing tube for causing the projection to move relatively along the groove and the ballpoint to be extended out of and retracted into the body tube by relative rotation of 360° between the cap and the body tube.

3 Claims, 3 Drawing Sheets

STRUCTURE OF DRIVING THE BALL REFILL FOR A BALL POINT PEN

BACKGROUND OF THE INVENTION

1. Field of the Invention

The present invention relates to a drive for a refill for a ballpoint pen having a driving axial tube and driving casing tube with a continuous groove and a projection engaged therein so that the cap of the pen can continuously rotate by 360° in both the positive or negative direction in order to achieve the function of freely extending or retracting a ballpoint refill.

2. Description of the Prior Art

For a conventional writing tool of the telescopic ballpoint pen type, there are two types of telescopic control of the ballpoint refill, namely, the contact compression type and the rotation driving type. Although there are many types of rotation driving structures for the ballpoint refills, the general defects are that they have too many elements and too complicated a structure, thus causing a combination of inconvenience and too high cost. Moreover, in operation and use, the conventional rotation driving structures for the ballpoint refill are mostly of the type for single direction rotation driving for extension of the ballpoint refill and reverse direction rotation to retract the ballpoint refill if desired, i.e. the extension or retraction of the ballpoint refill cannot be achieved by continuously rotating the cap of the pen through 360° but must be achieved by reciprocal rotating operations, thus causing much inconvenience in use. In addition, improper attempts to rotate the structure in the wrong operational direction may cause damage to the driving system. Further, at the present time, the specification of the ballpoint refills for a higher grade of pens can be classified in two major systems, namely the systems respectively used in pens sold under the trademarks PARKER and CROSS. As the conventional ballpoint pens are restricted to their inherent structures, they can only use refills of given specifications, and refills other than those meeting the originally used specifications cannot be used, thus causing the burden and annoyance to users of purchasing only limited types of refills.

SUMMARY OF THE INVENTION

To overcome the above drawbacks, the present invention provides a structure for a simple and practical design of a drive for a ballpoint pen refill for a ballpoint pen, with a driving structure comprising an external casing tube, a driving axial tube, a compression spring and a driving casing tube. After the ballpoint refill is screwed into the driving axial tube and they are disposed in the external casing tube, a compression spring is placed around the lower end of the driving axial tube, and the driving axial tube is encased in the driving casing tube so that the external driving casing tube is engaged by the compression spring urged by the driving casing tube. A concave ring in the wall of the external casing tube is engaged with a concave ring in the middle section of the driving casing tube. The driving axial tube has a continuous groove curved up and down the tube wall. A projection is provided at a suitable position on the driving casing tube so that the depression is engaged in the continuous groove. When the pen tube is rotated, the depression will cause an up and down displacement of the axial driving tube through continuous rotation through 360° to control the extension and retraction of the ballpoint refill. The topmost end and the bottommost end of the continuous groove respectively have an upward and a downward concave arc portion for preventing the ballpoint refill from retracting inwardly at the position of those two ends.

The principal object of the invention is to utilize the mutual movement of the driving axial tube and the driving casing tube in order to enable the ballpoint refill to follow the driving structure to rotate 360° during extension and retraction so that the simplest elements can be assembled to form a rational driving mechanism from a simple combination of those elements in order to provide performance of expected precision by a simple and low cost structure.

A further object of the invention is to provide a groove shape such that at the positions at the top and bottom ends of the revolving continuous groove in the driving axial tube there are respectively provided an upward and a downward blocking concave arc, so that at the highest or lowest point in its travel, the movement of the ballpoint refill will be restricted by such blocking concave arcs by restricting movement of the concave depression in the driving casing tube in order to avoid the occurrence of unintended retraction and extension of the ballpoint refill at the time of writing and to provide the user an ideal and convenient positioning of the ballpoint refill.

Another object of the invention is to provide a suitable size of the bore (inside diameter) of the driving casing tube which can receive the ballpoint refill of a PARKER type refill while at the terminal outlet of the pen tube, a return spring is provided for urging a PARKER type refill inwardly so that the PARKER type refill can be used with the driving structure of the invention in order to make it convenient for the user in selecting and replacing the refills as desired and so that the user is not limited to one particular type of refill.

DESCRIPTION OF THE PREFERRED EMBODIMENTS

Figure 1:
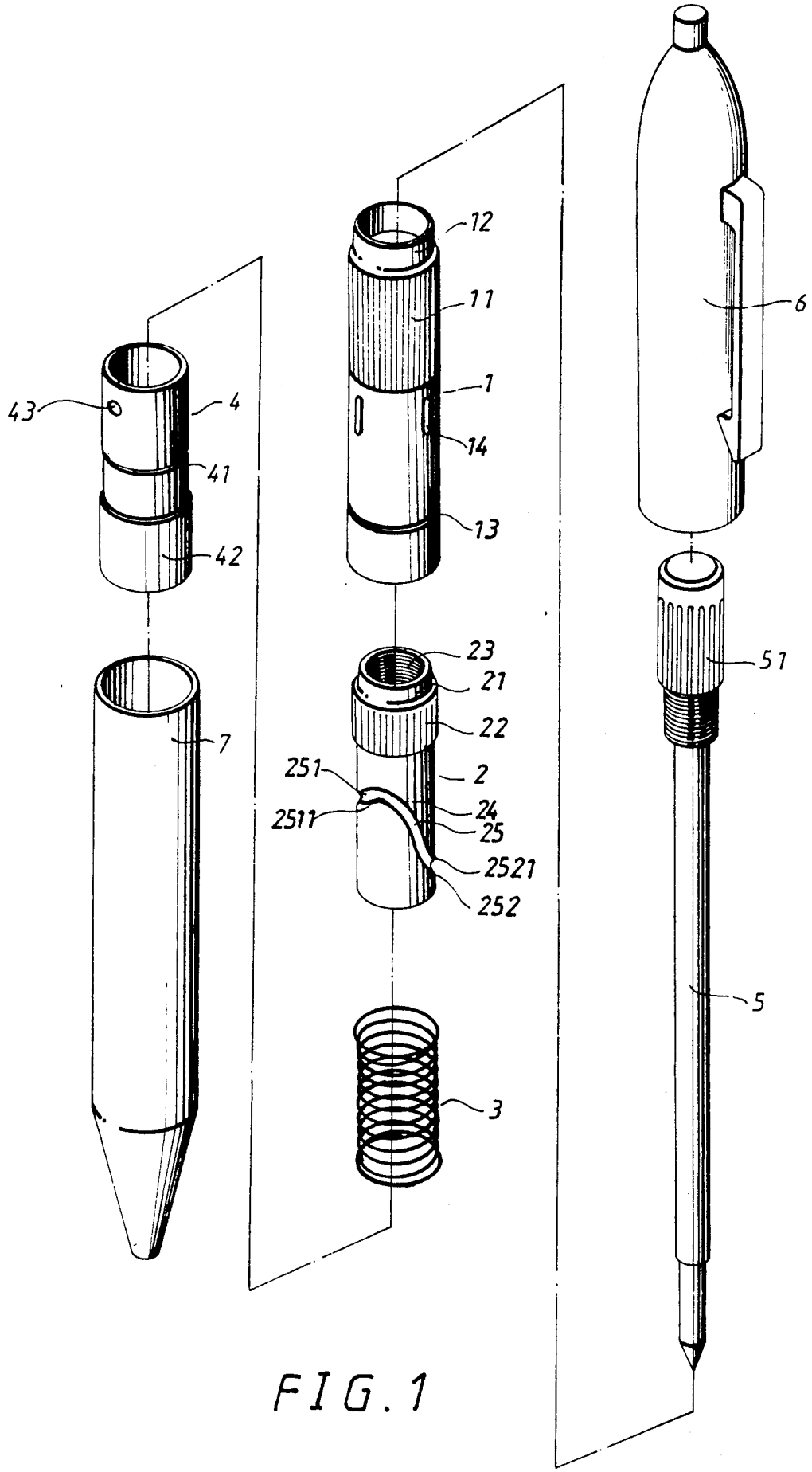
FIG. 1 is an exploded perspective view of the structure of the refill driving structure according to the invention.

As shown in FIG. 1, the structure of the invention includes external casing tube 1, driving axial tube 2, compression spring 3, and driving casing tube 4, assembled to form the driving structure of the ballpoint refill and encased within a cap 6 and a body tube 7 to form the structure of the pen in which the ballpoint refill 5 can be extended or retracted by continuous rotation through 360°.

External casing tube 1 is provided with parallel longitudinally extending ribs 11 on the outer periphery of its upper portion and with a reduced diameter neck portion 12 on its upper end, and also has a concave ring 13 therearound near its lower end at a suitable position. This concave ring 13 is engaged with a corresponding concave ring 41 in the driving casing tube 4 described below when the driving casing tube 4 is encased in the external casing tube so that the external casing tube 1 and the driving casing tube 4 are engaged so as to be fixed against relative axial movement yet to be relatively rotatable and, on the outer periphery of the middle section of the tube body, are provided with several longitudinally extending projections 14.

Driving axial tube 2 has a neck portion 21 slightly smaller in outer diameter than the internal diameter of the neck portion 12 of the external casing tube 1. Extending downward from the neck portion 21 is a longitudinally ribbed portion 22 extending around the tube body and on the inner surface of the neck portion 21 are suitable screw threads 23 for screwing onto a threaded portion 5*a* of a ballpoint refill 5 when it is inserted through the neck portion 21. The driving axial tube 2 has a slightly smaller diameter tube body 24 extending downwardly from ribbed portion 22 which is provided with a continuous sinuously curved groove 25 from a top downwardly curved arc 2511 to a bottom upwardly concave arc 2521. The continuous groove 25 surrounds the tube body 24 at a suitable slanting angle thus forming a topmost terminal portion 251 and a bottommost terminal portion 252 at which the width of the groove can be enlarged.

Compression spring 3 surrounds the smaller diameter tube body 24 of the driving axial tube 2.

Driving casing tube 4 is a hollow stepped tube body, provided with a concave ring 41 in the middle section of the tube body. It has a larger diameter stepped tube body portion 42 at the bottom thereof, and in a selected position near the upper end there is provided an inwardly extending projection 43 formed, for example, by punching.

Figure 2:
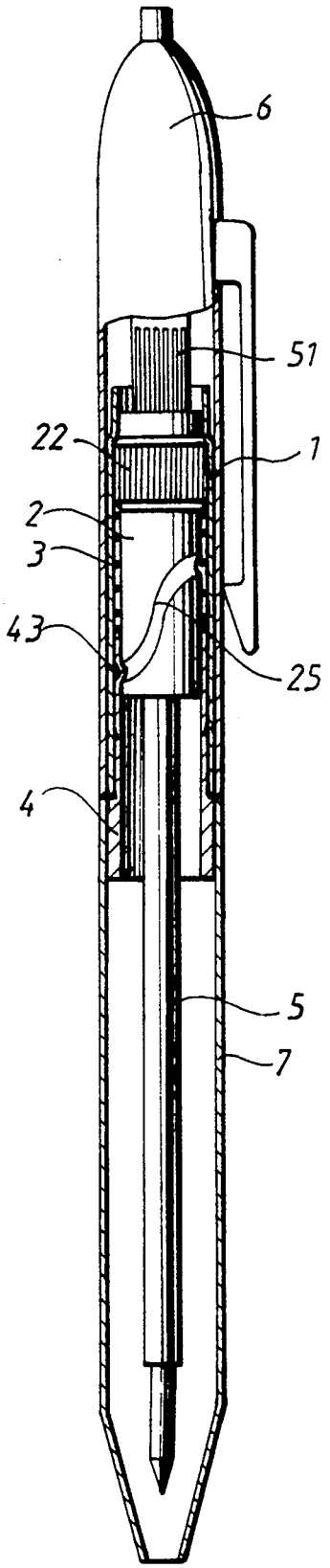
FIG. 2 is a partial sectional elevation view of the structure of the invention, wherein the ballpoint refill is in the retracted state.

As assembled, as shown in FIG. 2, with the compression spring 3 on the smaller diameter tube body 24 of the driving axial tube 2, the driving casing tube 4 is placed over the driving axial tube 2 around the smaller diameter tube body 24 and urges compression spring 3 against ribbed portion 22 and has projection 43 engaged in the continuous groove 25 in the driving axial tube 2 so that rotation of the driving axial tube 2 within the driving casing tube 4 will cause axial displacement of the driving axial tube 2 by the movement of the continuous groove 25 of the driving axial tube 2 past the projection 43. The driving casing tube 4, after assembly within the driving axial tube 2, is inserted into the external casing tube 1 and coupled thereto by engagement of the concave ring 41 in the middle section of the driving casing tube 4 and the corresponding concave ring 13 in the external casing tube 1 in a suitable position at the lower end of the tube body 14 of the external casing tube 1 so that the driving casing tube 4 is located in the interior of the external casing tube 1 so as to be rotatable thereon but held against axial movement. At this point, ribbed portion 22 is slidable in but non-rotatable relative to external casing tube 1. The ballpoint refill 5 is aligned with and inserted into the neck portion 12 of the external casing tube 1 and the casing cap 51 on the upper end of the ballpoint refill is rotated to tightly engage the screw threads 5*a* with the screw threads 23 provided in the neck portion 21 of the driving axial tube 2, so that the ballpoint refill 5 is tightly fixed to the driving structure. The cap 6 can then be placed over the external casing tube 1 and pressed down and held in position by the longitudinally extending projection 14 on the external casing tube 1. The body tube 7 is fastened tightly to the stepped tube body 42 of the driving casing tube 4, for example, by adhesive.

Figure 3:
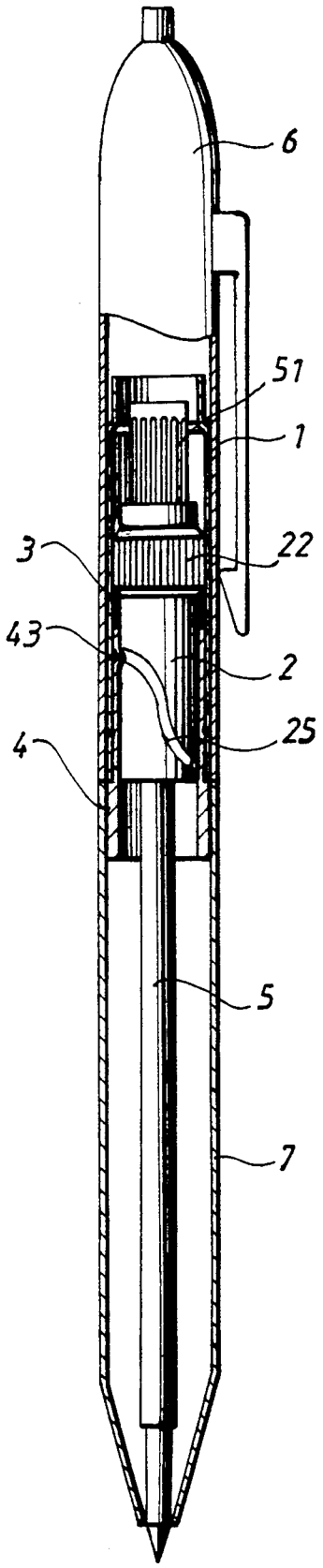
FIG. 3 is a view similar to FIG. 2, wherein the ballpoint refill is in the extended state ready for writing.

In using the invention, due to the tight fastening of the tube 7 to the tube body 42 of the driving casing tube 4, it is possible to cause the driving casing tube 4, by rotating the cap 6 or tube 7, to rotate the projection 43 relative to driving axial tube 2 to move along the continuous groove 25 of the driving axial tube 2 to drive the driving axial tube 2 and with it the ballpoint refill 5 upward and downward between the positions of FIG. 2 and FIG. 3. By the sinuously curved continuous groove 25 having the topmost and bottommost terminal portions 251 and 252, the driving casing tube 4, in revolving within the external casing tube 1 at the inserted position, can make the ballpoint refill 5 perform an up and down retracting and extending movement as shown in FIGS. 2 and 3, i.e. due to the projection 43 located at the bottommost terminal portion 252 of the continuous groove 25, the ballpoint refill 5 is held in the retracted position of FIG. 2, and for the same reason, as shown in FIG. 3, when the projection 43 moves to the topmost terminal portion 251 of the groove 25, the ballpoint refill 5 will be displaced downward to project to an extent convenient for writing. Because the concave arcs 2511 and 2521 are separately provided at the topmost terminal and the bottommost terminal 251 and 252 of the continuous groove 25, when the ballpoint refill 5 is used for writing (as shown in FIG. 3), the projection 43 is restricted and will not allow inward retracting movement, and will therefore permit smooth writing.

Figure 4:
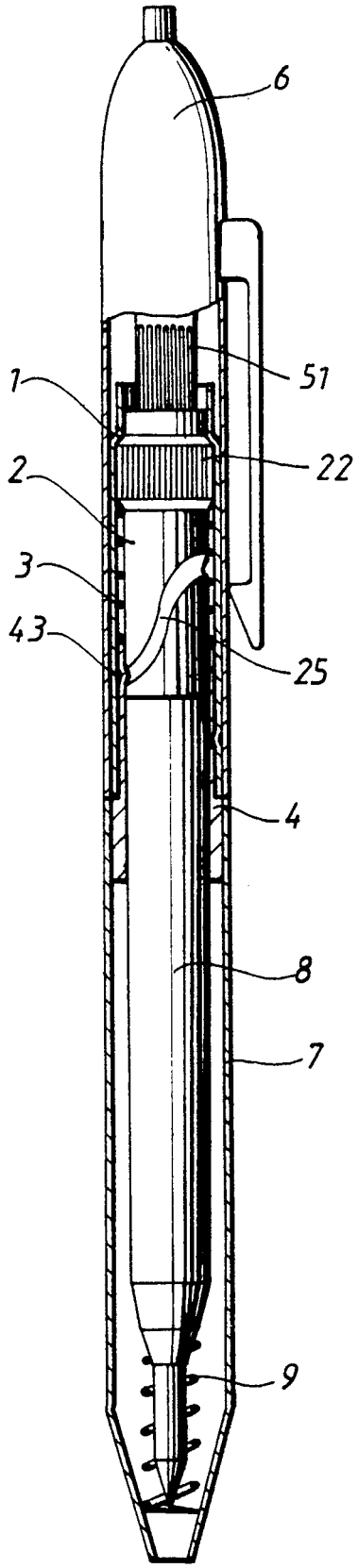
FIG. 4 is a partial sectional elevation view of a second example of the structure of the invention.

By proper sizing of the various driving structural elements, if a PARKER type ballpoint refill 8 is used, the top end surface of the ballpoint refill 8 and the bottom end surface of the driving casing tube 4 abut exactly as shown in FIG. 4, and the ballpoint end of the PARKER type ballpoint refill 8 is surrounded by a return spring 9 so that the spring 9 will urge the ballpoint refill 8 up coordinate with the rotation of the cap of pen 6 or the tube of pen 7, during the retracting rotation through 360°. Thus the user has the convenience of selecting either of the conventional type of ballpoint refills for use in the structure of the present invention.

In summary, the driving structure for the ballpoint refill for a ballpoint pen of the present invention is not only novel in structure, but also a more simple combination of elements, providing effective, convenient and rapid operation, and also being adaptable to use ballpoint refills of various specifications such as PARKER or CROSS type refills, so that the driving structure of the ballpoint pen can achieve effective practical and convenient operation.

I claim:

1. A refillable ball point pen structure in which the refill can be extended or retracted by relative rotation of the parts of the pen structure through three hundred and sixty degrees, comprising:

a body tube having a ball point exposing opening at the bottom thereof;

a driving casing tube fixed in the upper end of said body tube and having an inwardly projecting projection thereon;

an external casing tube fitted over said driving casing tube and engaged with said driving casing tube for relative rotation therewith and held against relative axial movement therewith;

a driving axial tube having a smaller diameter tube body within said driving casing tube and relatively rotatable therewithin and extending upwardly to within the upper end of said external casing tube and being axially slidable and non-rotatably engaged with the interior of said external casing tube, said smaller diameter tube body having a sinuously curved groove therearound with a downwardly concave arc at the upper end forming a topmost terminal portion and an upwardly concave arc at the lower end forming a bottommost terminal portion, said inwardly projecting projection being engaged in said groove for causing longitudinal movement of said driving axial tube upon relative rotational movement between said driving axial tube and said driving casing tube;

a spring means between said driving axial tube and said driving casing tube urging said driving axial tube upwardly within said external casing tube; and a cap fitted over said external casing tube and in which said external casing tube is relatively axially slidable and non-rotatable;

whereby with a ball point refill having a ball point thereon adjacent said ball point exposing opening and being held fixed in relation to said driving axial tube, relative rotation of said cap and said body tube causes relative rotation of said driving axial tube and said driving casing tube for causing said projection to move relatively along said groove and said ball point can be extended out of and retracted into said body tube by relative rotation of three hundred and sixty degrees between said cap and said body tube.

2. A refillable ball point pen structure as claimed in claim 1 in which the upper end of said driving axial tube has an interiorly threaded neck fitted within the upper end of said external casing tube, whereby the structure is adapted to receive a refill of the type having a small diameter body portion with a threaded portion around the upper end thereof for threaded engagement with said interiorly threaded neck for holding the refill fixed in relation to said driving axial tube and the small diameter body portion extending downwardly through said driving axial tube and said body tube.

3. A refillable ball point pen structure as claimed in claim 1 in which the lower end of said body tube has a return spring therein, whereby the structure is adapted to receive a refill of the type having a large diameter body portion having said return spring engaged with the lower end thereof for urging the upper end thereof into fixed relation with the lower end of said driving axial tube.

* * * * *